United States Patent [19]

Yatsuzuka et al.

[11] Patent Number: 4,817,410

[45] Date of Patent: Apr. 4, 1989

[54] ROLL FOR MILL

[75] Inventors: Takashi Yatsuzuka, Kitakyushu; Tetsuya Ohba; Kouji Tanabe, both of Muroran; Tatsuo Kojima, Gifu; Tatsunobu Kobayashi, Gifu; Kouki Katou, Gifu, all of Japan

[73] Assignees: Mitsubishi Kinzoku Kabushiki Kaisha; Nippon Steel Corporation, both of Tokyo, Japan

[21] Appl. No.: 58,174

[22] Filed: Jun. 4, 1987

[30] Foreign Application Priority Data

Jun. 19, 1986 [JP] Japan ..... 61-143865

[51] Int. Cl.[4] ..... B21B 27/02; B21B 31/08

[52] U.S. Cl. ..... 72/199; 29/113.1; 29/117; 29/122; 29/125; 29/127; 29/130; 72/236; 72/238

[58] Field of Search ..... 72/199, 236, 238; 29/130, 125, 117, 127, 128, 122, 113 R

[56] References Cited

U.S. PATENT DOCUMENTS

| | | | |
|---|---|---|---|
| 3,995,353 | 12/1976 | Wilson | 72/199 X |
| 4,117,705 | 10/1978 | Dempsey | 29/125 X |
| 4,208,147 | 6/1980 | Giege et al. | 29/117 |
| 4,455,856 | 6/1984 | Salter, Jr. et al. | 72/236 |
| 4,630,458 | 12/1986 | Kakabaker | 72/236 X |

FOREIGN PATENT DOCUMENTS

| | | |
|---|---|---|
| 56-53441 | 12/1981 | Japan . |
| 59-30303 | 2/1984 | Japan . |
| 59-25522 | 7/1984 | Japan . |
| 59-25521 | 7/1984 | Japan . |
| 59-40082 | 11/1984 | Japan . |

*Primary Examiner*—Robert L. Spruill
*Assistant Examiner*—Steven B. Katz
*Attorney, Agent, or Firm*—Scully, Scott, Murphy & Presser

[57] ABSTRACT

A roll for a mill includes a roll shaft having a tapered portion disposed intermediate opposite ends thereof. The tapered portion has an outer peripheral surface tapering axially of the roll shaft. A ring of a wear-resistant material is disposed around the tapered portion of the roll shaft. A tubular sleeve having an inner peripheral surface tapering axially thereof is press-fitted between the tapered portion of the roll shaft and the ring to retain the ring in place on the roll shaft for rotation therewith. The sleeve includes an inner groove formed in the inner peripheral surface thereof and a passageway formed therethrough. The passageway is communicated with the inner groove so that pressurized oil is supplied through the passageway into the inner groove.

8 Claims, 3 Drawing Sheets

ROLL FOR MILL

BACKGROUND OF THE INVENTION

1. Field of the Invention

The present invention relates to a roll for a mill having a ring of such a wear-resistant material as cemented carbide, ceramics and hard alloy mounted on a roll shaft.

2. Prior Art

As shown in FIG. 1 of the accompanying drawings, a conventional roll for a mill comprises a roll shaft 100, a tapered tubular sleeve 102, a ring 104 and a nut 106. The roll shaft 100 has a tapered portion 100*a* disposed intermediate opposite ends thereof, a flange portion 100*b* disposed adjacent to one end of the tapered portion 100*a* and an externally threaded portion 100*c* disposed adjacent to the other end of the tapered portion 100*a*. The ring 104 is disposed around the tapered portion 100*a* of the roll shaft 100, and the tapered sleeve 102 is press-fitted between the tapered portion 100*a* and the ring 104 to fix the ring 104 relative to the roll shaft 100 for rotation therewith. The nut 106 is threaded onto the threaded portion 100*c* of the roll shaft 100 so as to cooperate with the flange portion 100*b* to retain the sleeve 102 and the ring 104 in place.

The roll described above, however, possesses the drawbacks of requiring a great force for press-fitting the tapered sleeve 102 in place and for detaching it. As a result, it is not easy to mount and detach the sleeve 102, and besides the sleeve 102 has been susceptible to damage or wear. In addition, it has been difficult to obtain a sufficient and uniform clamping force with which the ring 104 is retained in place on the roll shaft 100 for rotation therewith.

In order to circumvent the above problems, a roll as shown in FIG. 2 has been conventionally developed. The roll comprises a roll shaft 110, a pair of collars 112 and 112, a ring 114 and a nut 116. The roll shaft 110, similarly to the roll shaft 100 described above, includes a tapered portion 110*a*, a flange portion 110*b* and an exteriorly threaded portion 110*c*. The roll shaft 100 further includes a spiral groove 118 formed in an outer peripheral surface of the tapered portion 110*a* and a passageway 120 formed therethrough so as to be communicated at its one end with the groove 118 and to open at its other end to an end face of the roll shaft 110. The ring 114 is press-fitted on the tapered portion 110*a* intermediate opposite ends thereof. The collars 112 and 112 are fitted on the tapered portion 110*a* at its opposite ends, respectively, so as to retain the ring 114 therebetween. The nut 116 is threaded onto the threaded portion 110*c* to cooperate with the flange portion 110*b* of the roll shaft 110 to firmly retain the ring 114 and the collars 112 in place. In such a roll, the ring 114 can be easily detached from the roll shaft 110 by causing pressurized oil to flow through the passageway 120 into the groove 118 to reduce the friction between the ring 114 and the roll shaft 110. The conventional roll, however, has a drawback that, when stress is concentrated in the roll shaft 110, the roll shaft 110 might be damaged since it includes the groove 118 and the passageway 120.

SUMMARY OF THE INVENTION

It is therefore an object of the present invention to provide a roll for a mill which has a roll shaft having a substantially increased strength and a ring mounted on the roll shaft with an increased clamping force, so that the roll can be effectively employed in such a case that a great rolling pressure is required, and permitting the ring to be easily detached from the roll shaft and mounted thereon.

According to the present invention, there is provided a roll for a mill comprising a roll shaft of a circular cross-section having an axis of rotation therethrough, the roll shaft including a tapered portion disposed intermediate opposite ends of the roll shaft, the tapered portion having an outer peripheral surface tapering axially of the roll shaft from one end of the tapered portion to the other end of the tapered portion, the roll shaft including a reduced-diameter portion having a diameter not greater than a diameter of the tapered portion, the reduced-diameter portion extending away from the other end of the tapered portion and terminating in one end of the roll shaft, a ring of a wear-resistant material disposed around the tapered portion of the roll shaft, the ring having an outer peripheral surface adapted to engage with a metal material to be rolled, and a tubular sleeve having an inner peripheral surface tapering axilly thereof and press-fitted between the tapered portion of the roll shaft and the ring with the inner peripheral surface being held in contact with the outer peripheral surface of the tapered portion to retain the ring in place on the roll shaft for rotation therewith, the sleeve including an inner groove formed in the inner peripheral surface of the sleeve and a passageway formed through the sleeve and communicated with the inner groove so as to supply pressurized oil to the inner groove through the passageway.

DESCRIPTION OF PREFERRED EMBODIMENTS OF THE INVENTION

Figure 1:
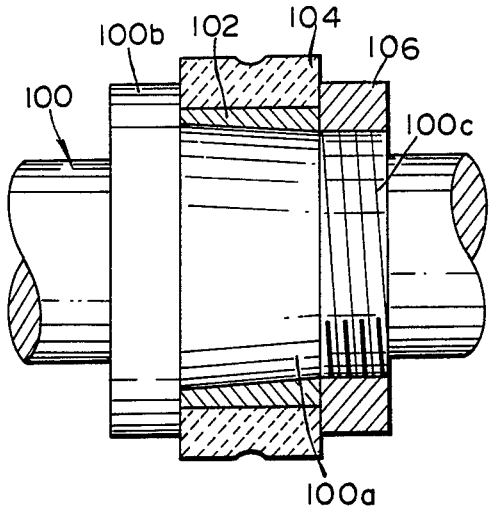
FIG. 1 (Prior Art)
FIG. 1 is a cross-sectional view of a conventional roll for a mill.
Figure 2:
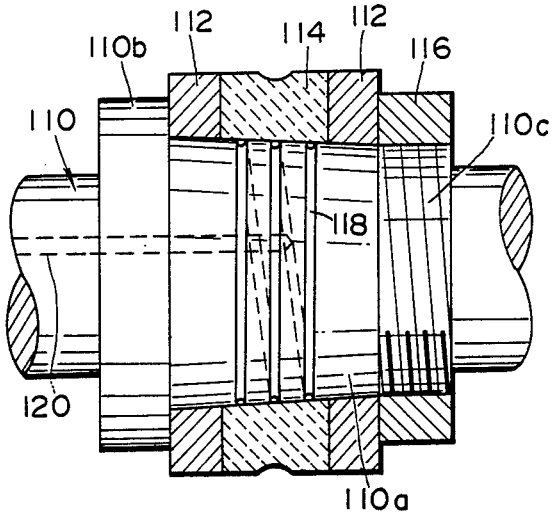
FIG. 2 (Prior Art)
FIG. 2 is a cross-sectional view of another conventional roll for a mill.

Various embodiments of the present invention will now be described with reference to FIGS. 3 to 7 of the accompanying drawings in which the same reference characters are used to designate like parts or elements.

Figure 3:
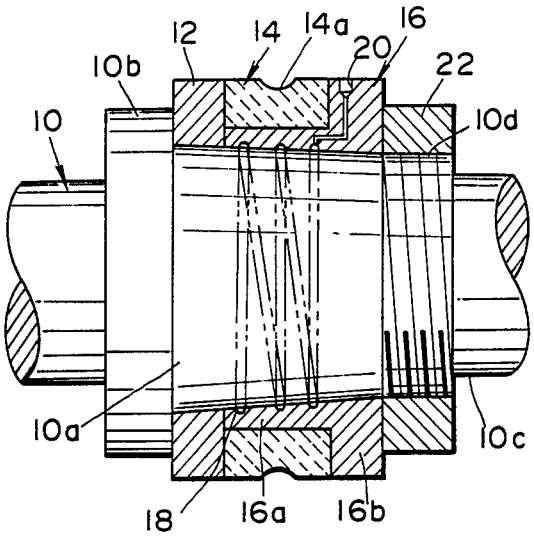
FIG. 3 is a cross-sectional view of a roll for a mill in accordance with the present invention.

Referring to FIG. 3, there is illustrated a roll for use in a mill in accordance with one embodiment of the present invention. The roll includes a roll shaft 10 of a circular cross-section having an axis of rotation therethrough. The roll shaft 10 includes a tapered portion 10*a* disposed intermediate opposite ends thereof, a flange portion 10*b* disposed adjacent to one end of the tapered portion 10*a* and a reduced-diameter portion 10*c* having a diameter not greater than a diameter of the tapered portion 10*a* which reduced-diameter portion extends away from the other end of the tapered portion 10*a* and terminates in one end of the roll shaft 10. The tapered portion 10*a* has an outer peripheral surface tapering in an axial direction away from the flange portion 10*b* toward the reduced-diameter portion 10*c*. The flange portion 10*b* projects radially outwardly of the roll shaft 10 so as to have an outer diameter larger than the diameter of the tapered portion 10*a*. The reduced-diameter portion 10*c* has an exteriorly threaded portion 10*d* disposed adjacent to the other end of the tapered portion 10*a*. A collar 12 having an inner peripheral surface tapering axially thereof and having an outer diameter larger than that of the flange portion 10*b* is fitted on the one end of the tapered portion 10*a* of the roll shaft 10 with one end face thereof being held in abutment with an end face of the flange portion 10*b* directed toward the tapered portion 10*a*. A ring 14 of such a wear-resistant material as cemented carbide, ceramics and hard alloy is disposed around the tapered portion 10*a* of the roll shaft 10 with one end face thereof being held in abutment with the other end face of the collar 12. The ring 14 has in an outer peripheral surface thereof a peripheral groove 14*a* with which a metal material to be rolled is brought into contact.

A tubular sleeve 16 having an inner peripheral surface tapering axially thereof is press-fitted between the tapered portion 10*a* of the roll shaft 10 and the ring 14, so that the ring 14 is firmly retained in place on the roll shaft 10 for rotation therewith. The sleeve 16 comprises a body portion 16*a* having a uniform outer diameter and a flange portion 16*b* integrally formed therewith at one end thereof and having an outer diameter which is larger than that of the body portion 16*a* and generally equivalent to that of the collar 12, the end face of the body portion 16*a* being held in abutment with the other end face of the collar 12 while one end face of the flange portion 16*b* directed toward the body portion 16*b* is held in abutment with the other end face of the ring 14. The sleeve 16 also includes an inner groove 18 formed in an inner peripheral surface thereof and extending spirally axially thereof and a passageway 20 formed therethrough, the passageway 20 being communicated at its one end with one end of the inner groove 18 and opening at its other end to an outer peripheral surface of the flange portion 16*b* of the sleeve 16. A nut 22 is detachably threaded onto the threaded portion 10*d* of the roll shaft 10 with one end face thereof being held in abutment with the other end face of the flange portion 16*b* of the sleeve 16 to cooperate with the flange portion 10*b* of the roll shaft 10 to retain the sleeve 16, the ring 14 and the collar 12 in place.

In the roll described above, when the ring 14 is to be detached from the roll shaft 10, the nut 22 first is removed from the threaded portion 10*d* of the roll shaft 10. A hose (not shown) connected at its one end to a source of pressurized oil then is connected at its other end to the opening end of the passageway 20, and pressure oil is caused to flow through the passageway 20 into the inner groove 18. Then, together with the ring 14, the sleeve 16 is removed from the roll shaft 10. Since the pressurized oil supplied into the groove 18 reduces friction exerted between the roll shaft 10 and the sleeve 16 during detaching operation, the sleeve 16 can be easily detached from the roll shaft 10, thereby preventing the sleeve 16 from being subjected to flaws or wear. For press-fitting the sleeve 16 between the ring 14 and the roll shaft 10, the pressurized oil is similarly supplied through the passageway 20 into the groove 18 to reduce the friction between the roll shaft 10 and the sleeve 16, thereby facilitating the press-fitting of the sleeve 16. As a result, the sleeve 16 can be easily detached and press-fitted, thereby being not susceptible to any flaw or wear, and besides it is easy to obtain a sufficient and uniform clamping force for retaining the ring 14 in place on the roll shaft 10 for rotation therewith. Furthermore, since the roll shaft 10 includes neither groove nor passageway therein, it has such an increased strength as not to be susceptible to damage even in a case where a greater rolling pressure is required.

Figure 4:
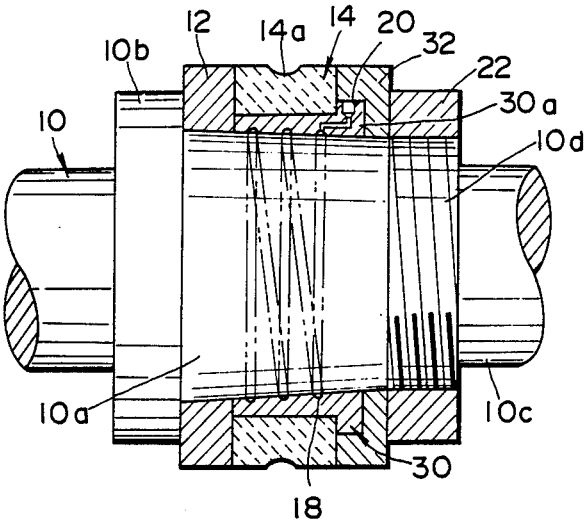
FIG. 4 is a cross-sectional view of a modified roll in accordance with the present invention.

FIG. 4 shows a modified roll in accordance with the present invention. The roll differs from the aforementioned roll in that a sleeve 30 press-fitted between the ring 14 and the roll shaft 10 includes at one end thereof a flange portion 30*a* having an outer diameter smaller than the outer diameter of the ring 14, and that a second collar 32 having an annular recess 32*a* formed in one end face thereof is fitted on the other end of the tapered portion 10*a* of the roll shaft 10 with the one end face thereof being held in abutment with the other end face of the ring 14 while the other end face thereof in abutment with the one end face of the nut 22, so that the flange portion 30*a* is fitted in the recess 32*a*. When the sleeve 30 is to be detached from the roll shaft 10, the nut 22 and the collar 32 are removed from the roll shaft 10. Subsequently, similarly to the case with the aforementioned roll, a hose connected to a source of pressurized oil is connected to the passageway 20, and the pressurized oil is caused to flow through the passageway 20 into the inner groove 18 to reduce the friction between the sleeve 30 and the roll shaft 12. Thus, together with the ring 14, the sleeve 30 is easily detached from the roll shaft 10.

Figure 5:
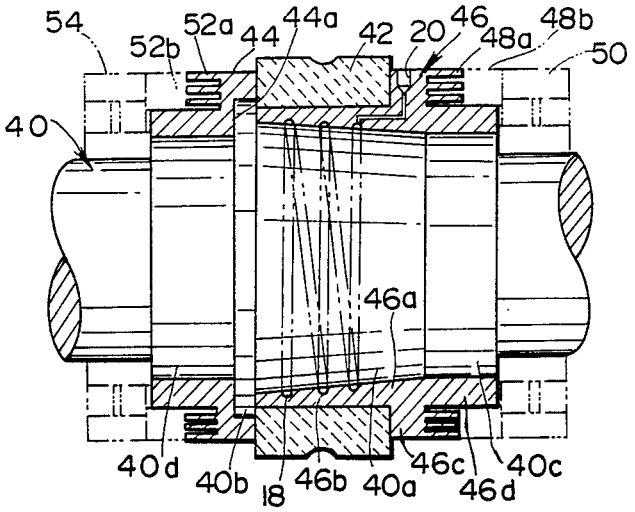
FIG. 5 is a cross-sectional view of another modified roll in accordance with the present invention.

FIG. 5 shows another modified roll which comprises a roll shaft 40, a ring 42, a third collar 44 and a tubular sleeve 46. The roll shaft 40 has a tapered portion 40*a* disposed intermediate opposite ends thereof, a flange portion 40*b* disposed at one end of the tapered portion 40*a*, a first reduced-diameter cylindrical portion 40*c* extending away from the other end of the tapered portion 40*a* toward one end of the roll shaft 40, and a second reduced-diameter cylindrical portion 40*d* extending away from the flange portion 40*b* toward the other end of the roll shaft 40. The sleeve 46 has a tapered portion 46*a* consisting of a body portion 46*b* and a flange portion 46*c*, and a cylindrical end portion 46*d* disposed adjacent to the flange portion 46*c* of the tapered portion 46*a*, the tapered portion 46*a* having an inner peripheral surface tapering axially thereof, similarly to the sleeves in the aforementioned embodiments. The ring 42 is disposed around the tapered portion 40*a* of the roll shaft 40, and the sleeve 46 is press-fitted between the ring 42 and the roll shaft 40 so that the tapered inner peripheral surface of the tapered portion 46*a* and the cylindrical inner peripheral surface of the end portion 46*d* are held in contact with the outer peripheral surfaces of the tapered portion 40*a* and the first cylindrical portion 40*c*, respectively. In addition to the inner groove 18 and the passageway 20, the sleeve 46 includes a first annular labyrinth portion 48*a* formed integrally on an end face of the flange portion 46*c* directed away from the ring 42, the labyrinth portion 48*a* being disposed around the roll shaft 40. The labyrinth portion 48*a* cooperates with a first labyrinth member 48*b* mounted on first bearing means 50 rotatably journalling the roll shaft 40 to define a first labyrinth seal to prevent foreign matters such as dirt and cooling water from entering the bearing means, the first bearing means 50 being disposed adjacent to the first cylindrical portion 40*c* of the roll shaft 40. The third collar 44 has an annular recess 44*a* formed in one end face thereof, and is fitted on the second cylindrical portion 40*d* of the roll shaft 40 with the one end face thereof being held in abutment with one end face of the ring 42, the flange portion 40*b* being fitted in the recess 44*a* of the collar 44. The collar 44 also has a second annular labyrinth portion 52*a* formed integrally thereon and disposed around the roll shaft 40, which portion, similarly to the above first labyrinth member 48*a*, cooperates with a second labyrinth member 52*b* mounted on second bearing means 54 rotatably journalling the roll shaft 40 to define a second labyrinth seal to prevent foreign matters from entering the bearing means, the second bearing means 54 being disposed adjacent to the second cylindrical portion 40*d*. In this roll, the ring 42 is firmly retained in place on the roll shaft 40 for rotation therewith by the sleeve 46, the collar 44 and the flange portion 40*b* of the roll shaft 40. And, when required to detach the sleeve 46 or to press-fit it, pressurized oil is supplied through the passageway 20 into the groove 18 to reduce the friction between the roll shaft 40 and the sleeve 46, thereby facilitating the detaching or press-fitting operation.

Figure 6:
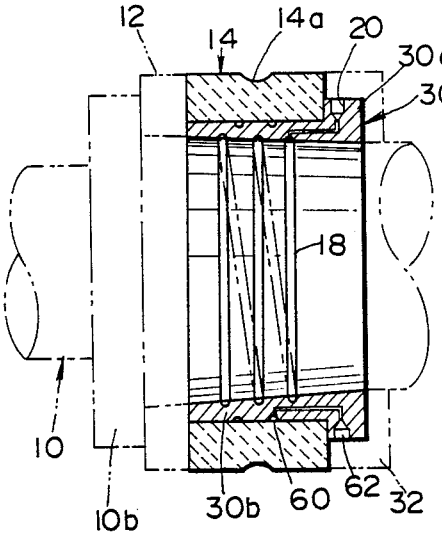
FIG. 6 is a cross-sectional view of a further modified roll in accordance with the present invention.

FIG. 6 shows a further modified roll which differs from the roll shown in FIG. 4 in that an outer peripheral spiral groove 60 is formed in an outer peripheral surface of a body portion 30*b* of the sleeve 30, and that a second passageway 62 communicated at one end thereof with the outer groove 60 is formed through the sleeve 30 so that the other end of the passageway 54 opens to the outer peripheral surface of the flange portion 30*a* of the sleeve 30. With this construction, pressurized oil can be caused to flow not only into the inner groove 18 but also into the outer groove 60, thereby facilitating detaching of the ring 14 from the sleeve 30 and mounting it on the sleeve 30 as well as detaching and mounting of the sleeve 30.

Figure 7:
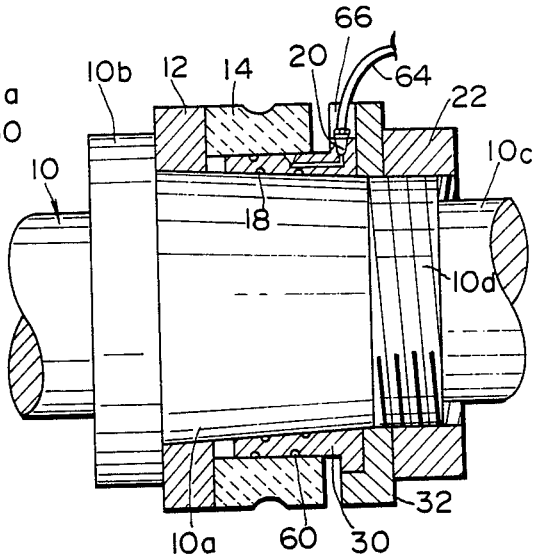
FIG. 7 is a cross-sectional view of a further modified roll in accordance with the present invention, the roll being shown in a state during a detaching operation.

FIG. 7 shows a further modified roll which differs from the roll shown in FIG. 6 in that the passageway 20 is communicated with both the inner groove 18 and the outer peripheral spiral groove 60 to omit the second passageway 62. In FIG. 7, 64 denotes a hose for supplying pressurized oil to the passageway 20, and 66 denotes a notch formed in the outer peripheral wall portion of the collar 32 for connecting the hose 64 to the opening end of the passageway 20.

As described above, since the pressurized oil supplied into the inner groove reduces friction exerted between the roll shaft and the sleeve during detaching and press-fitting operations, the sleeve can be easily detached from the roll shaft and press-fitted thereon, thereby preventing the sleeve from being damaged. Accordingly, it is easy to obtain a sufficient and uniform clamping force for retaining the sleeve and the ring in place on the roll shaft for rotation therewith, and the roll in accordance with the present invention can be effectively employed in such a case that a greater rolling pressure is required. Furthermore, since the roll shaft includes neither groove nor passageway therein, the roll shaft has such an increased strength as not to be susceptible to damage even in such a case that a greater rolling pressure is required.

What is claimed is:

1. A roll for a mill comprising:

a roll shaft of a circular cross-section having an axis of rotation therethrough, said roll shaft including a tapered portion disposed intermediate opposite ends of said roll shaft, said tapered portion having an outer peripheral surface tapering axially of said roll shaft from one end of said tapered portion to the other end of said tapered portion, said roll shaft including a reduced-diameter portion having a diameter not greater than a diameter of said tapered portion, said reduced-diameter portion extending away from said other end of said tapered portion and terminating in one end of said roll shaft;

a ring of a wear-resistant material disposed around said tapered portion of said roll shaft, said ring having an outer peripheral surface adapted to engage with a metal material to be rolled; and a tubular sleeve having an inner peripheral surface tapering axially thereof and press-fitted between said tapered portion of said roll shaft and said ring with said inner peripheral surface being held in contact with said outer peripheral surface of said tapered portion to retain said ring in place on said roll shaft for rotation therewith, said sleeve including an inner groove formed in said inner peripheral surface of said sleeve and a passageway formed through said sleeve and communicated with said inner groove so as to supply pressurized oil to said inner groove through said passageway.

2. A roll for a mill according to claim 1, in which said inner groove extends spirally axially of said sleeve.

3. A roll for a mill according to claim 1, in which said sleeve includes an outer groove formed in an outer peripheral surface with which an inner peripheral surface of said ring is held in contact and a second passageway formed through said sleeve and communicated with said outer groove so as to supply the pressurized oil to said outer groove through said second passageway.

4. A roll for a mill according to claim 1, in which said sleeve includes an outer groove formed in an outer peripheral surface with which an inner peripheral surface of said ring is held in contact, said passageway being communicated with said outer groove so as to supply the pressurized oil thereto.

5. A roll for a mill according to claim 3 or claim 4, in which said outer groove extends spirally axially of said sleeve.

6. A roll for a mill according to claim 1, in which said roll shaft has a flange portion disposed adjacent to said one end of said tapered portion and an exteriorly threaded portion disposed adjacent to said other end of said tapered portion, and in which a collar is mounted on said one end of said tapered portion with one end face of the collar being held in abutment with said flange portion while the other end face of the collar is held in abutment with one end face of said sleeve and one end face of said ring, and in which a nut member is detachably threaded onto said threaded portion of said roll shaft and held in engagement with the other end face of said sleeve so as to retain said sleeve and said ring between said flange portion of said roll shaft and said nut member.

7. A roll or a mill according to claim 6, in which said sleeve includes a flange portion having an end face held in abutment with the other end face of said ring, and in which a second collar having an annular recess formed in one end face thereof is mounted on said other end of said tapered portion with said one end face of the second collar being held in abutment with said other end face of said ring while the other end face of the second collar is held in abutment with said nut member, said flange portion of said sleeve being fitted in said recess of said second collar.

8. A roll for a mill according to claim 1, in which said roll shaft has a flange portion disposed adjacent to said one end of said tapered portion and a cylindrical portion extending from said flange portion away from said tapered portion, said roll shaft being adapted to be rotatably supported by first and second bearing means disposed adjacent to said tapered portion and said cylindrical portion of said roll shaft, respectively, said first and second bearing means having first and second annular labyrinth members disposed around said roll shaft, respectively, and in which said sleeve includes a flange portion having one end face held in contact with one end face of said ring and directed toward said flange portion of said roll shaft, said flange portion of said sleeve having a first annular labyrinth portion formed integrally on the other end face of said flange portion of said sleeve and disposed around said roll shaft, said first labyrinth portion being adapted to cooperate with said first labyrinth member to define a first labyrinth seal for preventing foreign matters from entering said first bearing means, and in which a third collar having an annular recess in one end face thereof is fitted on said cylindrical portion with said one end face of said third collar being held in abutment with the other end face of said ring, said flange portion of said roll shaft being fitted in said recess of said third collar, said third collar having a second annular labyrinth portion formed integrally thereon and disposed around said roll shaft, said second labyrinth portion being adapted to cooperate with said second labyrinth member to define a second labyrinth seal for preventing foreign matters from entering said second bearing means.

* * * * *